United States Patent [19]

Duffy et al.

[11] 4,120,993

[45] Oct. 17, 1978

[54] METHOD OF MAKING SELF-LOCKING FASTENERS

[75] Inventors: Richard Joseph Duffy, Salem; Philip James Rodden, Beverly, both of Mass.

[73] Assignee: USM Corporation, Farmington, Conn.

[21] Appl. No.: 837,897

[22] Filed: Sep. 29, 1977

Related U.S. Application Data

[63] Continuation of Ser. No. 683,067, May 4, 1976, abandoned.

[51] Int. Cl.[2] ..... B05D 3/02; B05D 1/36

[52] U.S. Cl. ..... 427/195; 10/10 P; 118/308; 118/314; 151/7; 427/201; 427/318

[58] Field of Search ..... 118/308, 310, 314; 151/7; 10/10 P; 427/185, 195, 201, 318

[56] References Cited

U.S. PATENT DOCUMENTS

| | | | |
|---|---|---|---|
| 3,416,492 | 12/1968 | Greenleaf | 118/308 X |
| 3,498,352 | 3/1970 | Duffy | 118/308 UX |
| 3,554,258 | 1/1971 | Duffy | 427/195 X |
| 3,713,862 | 1/1973 | Winkless | 118/308 X |
| 3,720,533 | 3/1973 | Gallagher | 427/195 X |
| 3,787,222 | 1/1974 | Duffy | 427/195 X |
| 3,791,842 | 2/1974 | Neal | 118/314 X |
| 3,797,455 | 3/1974 | Scheffer et al. | 118/308 |
| 3,894,509 | 7/1975 | Duffy et al. | 118/308 X |
| 3,896,760 | 7/1975 | Duffy | 118/308 |

*Primary Examiner*—Shrive P. Beck

*Attorney, Agent, or Firm*—Benjamin C. Pollard; Richard B. Megley; Vincent A. White

[57] ABSTRACT

The improved method of making a self-locking threaded element having a strongly adhered plastic body on its threaded surface providing strong frictional engagement between the element and a mating threaded surface in which fine particles of heat softenable plastic are applied against a heated threaded surface in a plurality of spaced successive portions in time and temperature controlled relation such that a first portion is softened by heat prior to application of a successive portion of the particles to aid in holding particles of successive portions to enable manufacture at a higher rate and/or at lower temperatures than heretofore practicable.

6 Claims, 4 Drawing Figures

METHOD OF MAKING SELF-LOCKING FASTENERS

This is a continuation, of application Ser. No. 683,067, filed May 4, 1976, and now abandoned.

FIELD OF THE INVENTION

This invention relates to improvements in methods of making self-locking threaded elements in which deformable plastic is secured on the threaded surface of the element in a relation to give strong locking action between the element and a mating threaded surface.

DESCRIPTION OF THE PRIOR ART

In U.S. Pat. No. 3,498,352, entitled Self-locking Threaded Element, which issued Mar. 3, 1970 in the name of R. J. Duffy, one of the present inventors, there is disclosed a self-locking threaded element and method of making in which a threaded element in heated condition is passed through a stream of fine particles of heat-softenable resin. The heated surface of the threaded element softens and catches resin particles striking the surface and melts the resin into a continuous retarder patch extending smoothly from one axially extending edge of the patch to the opposite edge of the patch and with smoothly changing thickness of the patch from a maximum thickness midway between the longitudinal edges to minimum thickness adjacent the edges. Width of the stream controls the time during which the fastener is subjected to the stream of particles and thus is a factor controlling the thickness of the retarder patch. In place of using the width of a single stream at a given rate of movement of the fastener, the heated threaded element may be moved at a higher rate through a series of streams of particles.

SUMMARY OF THE INVENTION

It is an object of the present invention to provide an improved method for forming a strongly adhered locking body of plastic on a threaded surface at a higher rate or at a lower temperature than heretofore practicable.

To these ends and in accordance with a feature of the present invention, we have formed a locking body of plastic on a threaded surface by applying fine particles of plastic in a plurality of spaced successive portions in time and temperature controlled relation.

BRIEF DESCRIPTION OF THE DRAWINGS

The invention will be described further in connection with the attached drawings in which.

DESCRIPTION OF THE PREFERRED EMBODIMENTS

The invention will be described in relation to providing a self-locking plastic body on an externally threaded article such as a bolt, but it is to be understood that it is useful in providing a self-locking body on internally threaded articles such as nuts.

Figure 1:
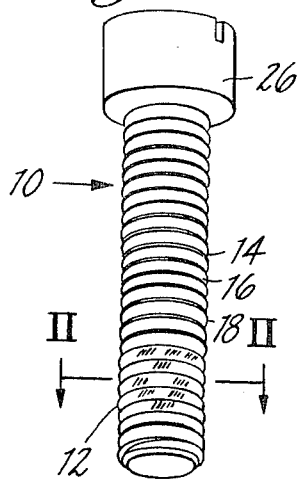
FIG. 1 is an angular view of one form of self-locking threaded fastener element made in accordance with the method of the present invention.
Figure 2:
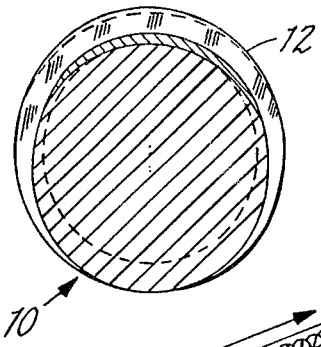
FIG. 2 is a cross sectional view on a larger scale on the line II—II of FIG. 1.

A locking type threaded element, shown as a bolt 10, (see FIGS. 1 and 2), manufactured according to the present method carries a deposit 12, i.e. a "retarder patch" or plastic body of tough resilient resin formed in situ on a selected area of the threaded surface of the fastener by deposition and melting of fine particles of thermoplastic resin on a heated surface of the fastener. A heat softenable primer or tying material (not shown) may be provided to aid in deposition of the plastic particles in the course of making and to give superior adhesion between the fastener surface and the retarder patch. The retarder patch 12 covers the valleys 14, the inclined helical bearing surfaces 16 and the crests 18 of the threaded surface, and is so located as to be compressed between the threaded surface of the fastener and mating threads of a complementary element with which the fastener is assembled to provide increased frictional resistance to undesired loosening of the assembled threaded elements.

The process of making such locking type fasteners will be described as it is practiced using the apparatus diagrammatically shown in FIGS. 3 and 4, but it will be understood that other apparatus than that shown may be used, or the process may be carried out by hand. In the apparatus a succession of threaded fastener elements shown as bolts 10 is conveyed on a carrier through the successive steps of the process. The carrier includes spaced parallel endless belts 20 traveling on pulley wheels 22 and 24. The fasteners preferably are suspended in vertical position with portions of the heads 26 resting on the spaced parallel moving belts 20 with depending portions exposed for treatment.

The fasteners are first moved through a heating station which could be an oven, but preferably is a high frequency heating unit designed to heat a succession of fasteners moving continuously past it on the carrier. As shown in the drawings, the coil 28 of the heating unit is elongated in the direction of movement of the fasteners on the carrier to raise them to the desired temperature.

From the heating station, the fasteners 10 are moved to a first station 30 and then to a further station 32 at which fine plastic particles are applied. At these stations, fine plastic particles, suitably as a uniform stream in air jets, are directed at the heated fasteners by nozzles 34. Particles of plastic from the streams are softened and caught on the surface of the fasteners by the sensible heat of the fasteners.

The devices for directing particles against the surfaces of the fasteners at the stations 30 and 32 may be similar to those used in the Duffy U.S. Pat. No. 3,579,684 and include jet nozzles 34 formed as flattened ends of tubular members 36 secured to one end of tubular manifolds 38, inlets 40 for supplying gas under pressure to the manifolds and inlets 42 through which plastic particles are introduced. A metered plastic particle supply device 44 is disposed to supply particles to conduits 46 leading to the inlets 42, to the manifolds 38 and is arranged with a movable guide 48 such that the particles may be directed relative to the entrances to the conduits 46 so that a desired ratio of particles may be supplied to the two conduits or if desired all of the particles may be supplied to a single conduit.

In contrast to the method disclosed in U.S. Pat. No. 3,579,684, in which the entire quantity of plastic desired on the fastener is deposited in a continuous step, the rate of supply of plastic particles at the first station 30 and the time during which the fastener is exposed to the stream of particles in the first station 30 are controlled such that only a thin deposit, which may be from essentially a single layer of plastic particles up to preferably not more than about a half of the entire quantity of plastic desired, is deposited on the fasteners at this first station.

The fasteners are carried on from the first station to the second particle applying station 32, the distance between the stations being selected such that the time between the first and second stations is controlled relative to the quantity and melting characteristics of the plastic particles deposited at the first station that the deposits of plastic particles on the hot surfaces are substantially completely melted by the sensible heat of the fasteners and present molten surfaces for catching further plastic particles at the second station.

The fastener while still at a temperature above the melting point of the plastic and with the resin deposit in molten condition are then passed through the second station 32 at which fine plastic particles are applied. The molten plastic on the surfaces of the fasteners collects additional plastic particles more effectively and uniformly than would the uncoated hot surface of the fasteners and gives a rapid building up of the plastic deposit.

Particularly with smaller screws with limited heat capacity, it is found that a first thin deposit of plastic particles is easily and quickly melted and that a successive deposit of particles is both effectively caught in the melted first deposit and is in a desirable heat transfer relation for melting even where the temperature may have fallen below values used to catch and melt particles on a metallic screw surface.

This is in contrast to the known procedure in which all of the particulate plastic is applied in a single relatively thick deposit so that melting heat from the fastener must be conducted through the relatively loose deposit of particles which is poorly conductive and hence requires higher temperatures for melting and coalescing the deposited plastic.

Figure 4:
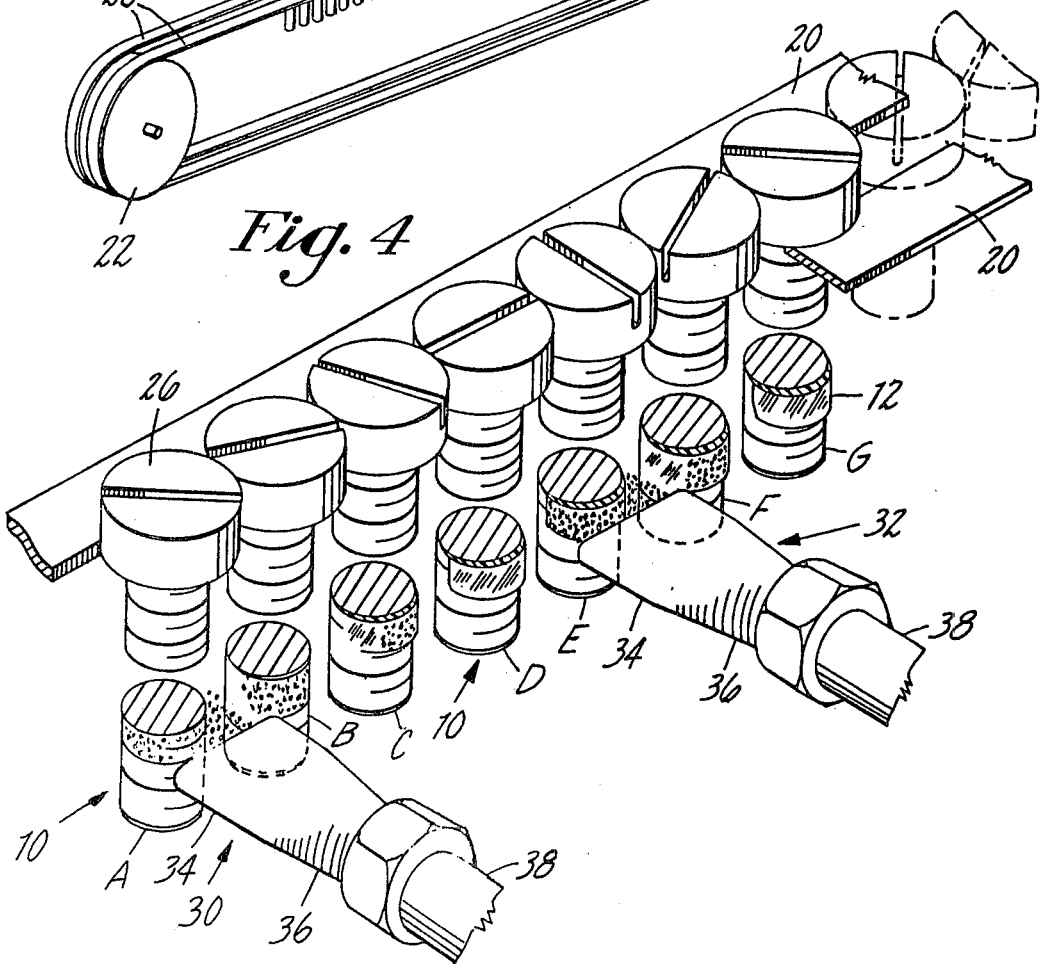
FIG. 4 is a diagrammatic, frictional, elevational view on a larger scale with parts broken away illustrating one arrangement of plastic particles applying stations and the stages in the formation of a plastic deposit on the threaded surface practicing the method of the present invention.

As shown more clearly in FIG. 4, a continuous series of fasteners is carried past the particle applying stations 30 and 32 so that the state of the applied plastic on successive fasteners illustrates the state of the applied plastic at successive increments of time after application of the particles. Thus Bolt A is a heated bolt just prior to application of particles.

Bolt B is a heated bolt 10 directly after application of the powder at the first station and in which the exposed surface of the deposited plastic is dull and powdery looking while the plastic material adjacent the hot surface of the bolt has begun to soften or melt and adhere to the bolt. Where the applied plastic particulate material is a mixture of a high melting tough plastic such as nylon and a lower melting material having good ability to wet metal surfaces, for example an epoxy resin, it appears that the material adjacent the hot surface of the bolt 10 will be enriched in or substantially consist of epoxy material. That is, two factors tend to cause this localization of epoxy adjacent the bolt surfaces: (1) the particles of epoxy in the mixture which strike the hot surface are more rapidly softened for wetting engagement with the bolt surfaces than are the nylon particles so that for a given quantity of powder mixture directed at the hot bolt surface a greater proportion of epoxy particles than of nylon particles is caught by the hot surfaces; and (2) by reason of its greater fluidity and wetting action toward the hot metal surface, the molten epoxy resin is drawn by surface tension into covering relation to the metal surface and in fact is withdrawn to some extent from association with the nylon in lower portions of the applied layer of particles.

Bolt C is a heated bolt a further increment of time after Bolt B and indicates an exposed surface of the deposited material in which the surface of edge portions of the plastic material on the bolt shows developing gloss indicating that the deposited material has almost fully melted, while the plastic particulate material on the thicker portions of deposited plastic more centrally of the deposit on the surface of the bolt has not fully lost the dull, matte appearance of deposited powder.

Bolt D indicates the condition of the deposited material, a brief time later than that of the Bolt C, at which the entire deposit of material presents a glossy surface indicating that the deposited material is fully melted.

Bolt E indicates the appearance of the bolt at a time at which a second deposit of powder from the second station 32 has been made against the molten material on the bolt. This surface like the surface of Bolt B has a dull powdery appearance indicating that the molten material has been covered by, and acts to hold on, the second deposit of powder.

Bolt F indicates the condition of a bolt a brief space of time after the second application of particulate material showing initial development of a glossy surface and indicating that the deposited particulate material is melting and becoming integral with the molten body of the first deposit material.

Bolt G has a completely glossy surface indicating that the second deposit of particles has become fully melted and integral with the first deposited material to form a continuous layer 12 over the threaded surfaces. The bolts on which the two deposits of material have been fully melted are then cooled to solidify the material for example by immersing them in an aqueous "soluble oil" solution.

To secure the action described in the device described above, the space between the two points of application of the particulate material is such that at an established rate of movement of the bolts 10 past the application points 30 and 32, and with a determined temperature of the bolts 10 at the time they pass the first application point, there will be sufficient time for the substantially fully molten stage of the first applied material to be reached as the second application station 32 is passed. By way of example and not of limitation, it may be noted that with a supply of ½ inch — 13 inches screws at 300 pieces per minute, that is, a linear speed of 3.2 seconds per foot, and with a bolt temperature of 575° F., action according to the above described progression was obtained with a spacing of the application points of approximately 3 inches. An important factor of the system is the self-regulating behavior with respect to small changes in speed of movement of the bolts. That is an increase in the speed with which the bolts are moved past the first application point 30 results in a somewhat reduced first deposit of particulate material and this smaller deposit melts faster so that it is substantially fully melted by the time the bolt reaches the second application point 32 even though a shorter time for melting has been available. Conversely slower speeds will result in a greater deposition of powder at the first station 32 but will allow a longer time for melting of this greater quantity of material before the bolt reaches the second application station 32.

If desired further plastic particles applying stations may be employed, i.e., more than two, with spacing such that plastic particles deposited at one station become melted to present a molten surface for collection of additional plastic particles at an adjacent further station.

The foregoing description has related primarily to the treatment of externally threaded fasteners in which the fasteners have been moved along a path for passage passed through streams of plastic particles spaced along the fastener path. However, it is to be understood that the method may be practiced by applying particles against a heated threaded fastener, whether moving or not, for a limited time and stopping this first application after depositing a first portion of particles less than that desired for the self-locking feature. When the first deposited portion of plastic particles has softened to a state effective to catch and hold further particles, further particles may be directed against the softened plastic to build up the deposit to a desired extent.

Also, the method may be used in forming a locking deposit on internally threaded fasteners, such as nuts, by a modification of the method disclosed in the patent to Duffy U.S. Pat. No. 3,858,262 of Jan. 7, 1975 entitled "Method of Making Self-Locking Internally Threaded Articles." That is plastic particles may be directed through one of the openings of a nut toward a selected area of the internally threaded surfaces of a heated nut for a limited time to deposit a first portion of particles less than that desired for the self-locking action; and after the first deposited portion of plastic has been softened, further particles may be directed against the softened plastic to build up the deposit to a desired extent.

It is believed that in addition to the important advantage of more rapid and effective deposition of plastic particles through use of plural applying stations which are in spaced relation dependent on time and temperature requirements, the deposition in spaced portions gives a more desirable distribution and character of the ultimate resin deposit. That is, deposition of the entire quality of particles in a single application step may cause a build up of a mass of plastic particles of which portions spaced from the hot fastener surface are not melted or coalesced. Although these particles may be subsequently melted down to a coherent continuous mass by heat from the fastener, the interparticle spaces in the piled up mass of particles may result in entrapped gas in the process of coalescence through melting. Also where the resin is deposited as a single built up deposit in which the particles spaced from the hot fastener surface are held in place by piling up of the particles, the distribution of plastic in the ultimate deposit may result in an undesirably greater thickness of resin along the line at which the surface of the fastener is at right angles to the stream of plastic particles. On the other hand, with plural spaced applications of plastic particles, the first applied particles are melted to a thin layer, and the later applied particles are caught and held efficiently in smoothly distributed relation in the previously melted plastic. Also the particles are applied in lesser quantities in each stage than would be required in a single stage operation so that loss of continuity through entrapped gas is less of a danger. More importantly, since the first applied resin is a substantially uniform all-over deposit on the fastener surface, and since this molten deposit is effective to hold plastic particles directed against it, a more even distribution of the plastic over the surface of the fastener is secured.

The patent to Duffy, U.S. Pat. No. 3,579,684, has pointed out the advantages of a coating of a heat softenable primer or tying agent to the fastener before heating of the fastener and application of plastic particles in catching and holding particles to build up a locking body. Presently it is preferred that the primer or tying agent be combined with the plastic particles of the locking deposit for example by using a powder mixture formed by combining a minor proportion, i.e., from about 5% to about 35% by weight of particles of a primer or tying agent, such as polyamide resins, epoxy resins, resorcinol aldehyde resins and combinations of these, with a major portion i.e., from about 95% to about 65% by weight of particles of the plastic material which makes up the main body of the locking deposit, both percentages being based on the weight of the powder mixture. In preferred operation, the primer or tying material has a lower melting point than does the plastic material and also is more fluid and more capable of wetting the threaded surface so that the heat of the threaded fastener causes it to fuse and flow into wetting engagement with the threaded surface to provide the desired primer and tying action. It is to be noted that in the plural stage particle application, much of the advantage of the particle catching action of the separately applied primer coating is obtained through complete melting of the first thin coating before deposition of the quantity of particles needed for the desired locking action.

The following examples are given to aid in understanding the invention and it is to be understood that the invention is not limited to the particular procedures, temperatures, times or other details given in the samples.

EXAMPLE 1

Figure 3:
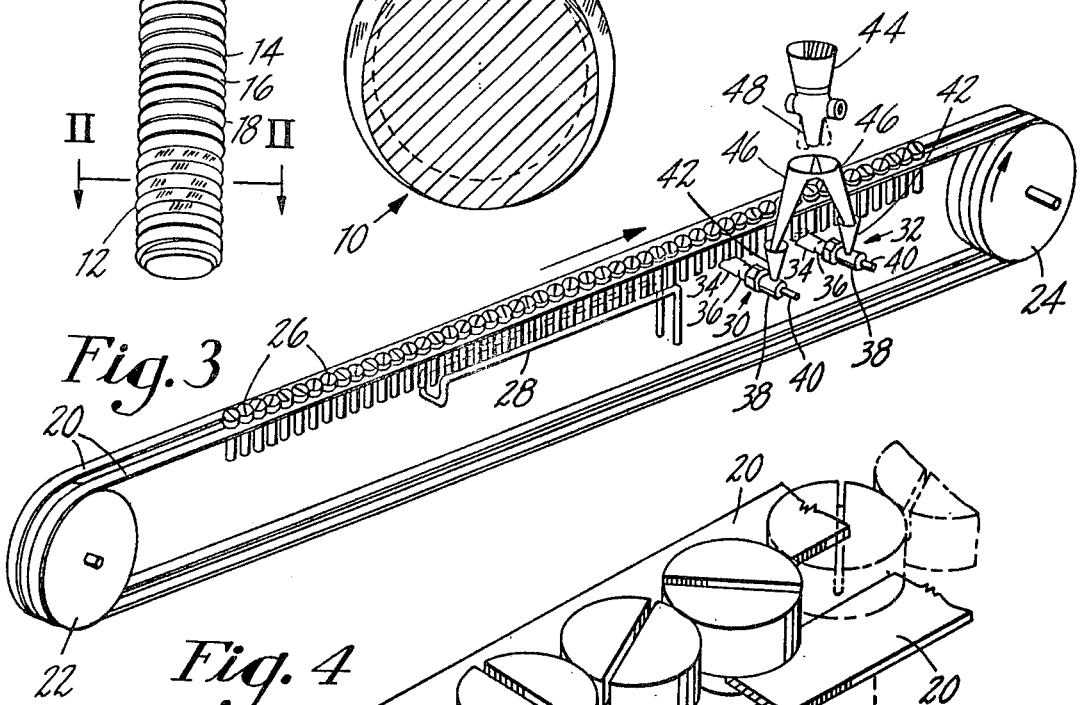
FIG. 3 is a diagrammatic elevational view illustrating apparatus useful for practicing the method of the present invention for forming a plastic deposit on the threaded surface.

Black iron bolts, ½ inch — 13 inches were deposited with their enlarged head portions resting on the two moving belts of an apparatus as shown in FIG. 3 and with the threaded surface extending down between the belts leaving the portions to be coated exposed. The belts were operated at a belt speed of 3.2 seconds per foot corresponding to 300 pieces per minute and the powder supply was adjusted to provide 85 grams per minute of a mixture of approximately 90% nylon powder and 10% of a thermosetting epoxy resin powder. The heating device was adjusted to provide that bolts leaving the heating device had reached a temperature of 575° F. The nozzles were arranged to direct streams of the powder mixtures transverse to the bolts and to the belts to provide a patch about ⅜ inch along the axis of the bolts with the lowermost portion of the resin approximate two threads from the ends of the bolts. As shown in FIG. 3 the powder supply was adjustable to split the powder into two streams or to direct all of the powder into a single stream.

In a first experiment, the supply was arranged to send approximately one half of the powder mixture to each of the applying stations. It was observed that the resinous material deposited at the first station was fully softened or melted to the point of developing a shiny surface by the time the screws had reached the second station and that the powder applied in the second station covered the glossy surface uniformly and melted promptly. After cooling, the applied coating was found to be uniform and to follow the contours of the threads effectively. Torque tests were carried out with Class 2 fit cadmium plated nuts. "First on" torque values averaged about 119 inch pounds and "first off" torque values averaged about 85 inch pounds.

In a second experiment, conditions were the same as in the first experiment except that all of the powder mixture from the powder supply passed to a single station. A full coating of the resin powder was deposited on the threads of the screws, melted to form a continuous layer and was cooled. It was observed that although a continuous coating was formed in the second experiment, the coating was significantly thinner than the coating of resin material formed in the first experiment. When subjected to the same torque tests, the "first on" torque values averaged about 85 inch pounds and the "first off" torque values averaged about 69.5 inch pounds.

EXAMPLE 2

In a further comparative test, using the same conditions except that in the first instance the powder flow was increased to 138 grams per minute and the belt speed was increased to deliver 400 pieces per minute, the following "first on" and "first off" torque values were obtained using in the first instance a split powder flow with one half going through each of two stations and in the second case, powder flow through a single station. For the two station experiment, "first on" torque values averaged about 132 inch pounds and "first off" torque values averaged about 105 inch pounds. For the single station experiment, "first on" torque values averaged about 48 inch pounds and "first off" torque values averaged about 33 inch pounds.

From these examples it can be seen that the use of spaced powder streams provided significantly greater coating action and produced significantly greater locking torque values than where the same quantity of powder is sent through a single nozzle. Also the spaced powder stream enabled greated processing speed than the single powder stream.

Having thus described our invention, what we claim as new and desire to secure by Letters Patent of the United States is:

1. In a method of providing a threaded surface of an article with a self-locking element comprising an adhered body of normally hard, tough, resilient resin including the steps of heating the threaded surface to a temperature above the softening point of said resin, thereafter directing a stream of fine particles of said resin to a selected area of said threaded surface while said threaded surface is at a temperature above said softening point, catching resin particles from said stream by softening them and causing them to be held on said threaded surface and to melt to a continuous resin body extending smoothly between generally axially extended edges of said area by heat from said threaded surface and solidifying said resin body, the improvement which comprises applying said resin particles in a plurality of spaced successive streams, controlling the rate at which and time during which resin particles of a first stream are directed to said threaded surface to form a deposit of a first portion of resin particles held on said threaded surface by heat softened resin and with exposed portions of said deposit retaining particulate character, said deposit of resin being in amount less than that desired in the self-locking element, maintaining said threaded surface at a temperature above said softening point for a time after completing deposition of said first portion of resin particles determined relative to the quantity and melting characteristics of the resin particles substantially completely to melt the deposited first portion of resin, thereafter directing a further stream of resin particles at the molten resin deposit where the particles are caught up and held by said molten resin to build up the quantity of resin on said threaded surface, coalescing the deposited resin to a substantially continuous body of resin extending smoothly between generally axially extending edges and cooling said body of resin to harden it to a solid body resistant to displacement and effective to give a locking action when a complementary threaded surface is assembled with said threaded surface.

2. The method of providing a threaded surface of an article with a self-locking element as defined in claim 1 in which the rate at which and time during which said first stream of resin particles is directed at said threaded surface are limited to form a deposit of resin particles in an amount from at least that substantially covering said selected area up to about one half the amount of resin desired in the self-locking element.

3. The method of providing a threaded surface of an article with a self-locking element as defined in claim 2 in which each of said streams of resin particles is entrained in a gaseous jet.

4. The method of providing a threaded surface of an article with a self-locking element as defined in claim 3 in which said article is a threaded fastener and is moved in a path successively through said streams of resin particles and in which said streams are spaced along the path of said fastener a distance correlated with the speed of movement of said fastener, the temperature of said fastener and the melting point of said resin to provide a time before said article is moved through a successive stream in which resin deposited by the first stream will melt substantially completely, and in which said streams are oriented transverse to said path and to the longitudinal axis of said fastener to direct resin particles against said selected area of said fastener and said fastener moves along said path.

5. The method of providing a threaded surface of an article with a self-locking element as defined in claim 4 in which said threaded fastener is a bolt disposed with its axis vertical and said streams are directed laterally against said selected area.

6. The method of providing a threaded surface of an article with a self-locking element as defined in claim 5 in which said resin particles include a major portion of fine particles of a normally hard thermoplastic resin and a minor portion of a heat softenable tying agent, and said tying agent is melted on the surface of said threaded portion to wet said portion and to aid in building up and adhering deposits of said normally hard thermoplastic resin on the surface of said threaded portion.

* * * * *

UNITED STATES PATENT OFFICE

CERTIFICATE OF CORRECTION

Patent No. 4,120,993 Dated October 17, 1978

Inventor(s) Duffy et al

It is certified that error appears in the above-identified patent and that said Letters Patent are hereby corrected as shown below:

Column 8, Line 14 after the word "caught" delete the word --up--

Signed and Sealed this

*Ninth* Day of *January 1979*

[SEAL]

*Attest:*

RUTH C. MASON
*Attesting Officer*

DONALD W. BANNER
*Commissioner of Patents and Trademarks*